US005099813A

United States Patent [19]

Kurosu et al.

[11] Patent Number: 5,099,813

[45] Date of Patent: Mar. 31, 1992

[54] ENGINE START CONTROL SYSTEM

[75] Inventors: Shinichi Kurosu, Tokyo; Yoshiki Yuzuriha, Isesaki, both of Japan

[73] Assignees: Fuji Heavy Industries Ltd., Tokyo; Japan Electronic Control Systems Co., Ltd., Isesaki, both of Japan

[21] Appl. No.: 603,447

[22] Filed: Oct. 26, 1990

[51] Int. Cl.[5] ..... F02D 41/06

[52] U.S. Cl. ..... 123/491; 123/179.17

[58] Field of Search ..... 123/179 G, 179 L, 76, 123/491, 73 A, 73 B, 73 C

[56] References Cited

U.S. PATENT DOCUMENTS

| | | | |
|---|---|---|---|
| 3,667,442 | 6/1972 | Bredlow | 123/179 F |
| 3,881,454 | 5/1975 | Jaulnes | 123/73 B |
| 4,809,649 | 3/1989 | Brinkman | 123/76 |

FOREIGN PATENT DOCUMENTS 63-255543 10/1988 Japan .

*Primary Examiner*—Tony M. Argenbright

*Attorney, Agent, or Firm*—Foley & Lardner

[57] ABSTRACT

An engine start control system wherein the engine is restarted after the engine is scavenged without supplying of fuel from a fuel injection valve by cranking only when the engine almost stops as well as when a driver wants to scavenge. The driver's intention to scavenge a combustion chamber of the engine is detected by a control switch which the driver can turn on or off or an opening degree of a throttle valve in an intake passage when the opening degree is equal to or exceeds a predetermined value.

6 Claims, 6 Drawing Sheets

ENGINE START CONTROL SYSTEM

BACKGROUND OF THE INVENTION (1) Field of the Invention

The present invention relates to an engine start control system and, more particularly, to a method for coping with the failure of an engine to start.

(2) Description of the Prior Art

The fuel supply system with an electronic fuel injection system using a fuel injection valve (as disclosed in Japanese Patent Laid-Open No. 63-255543) is adopted in some two-cycle engines to be used in a motorcycle or a snowmobile. According to this disclosure, for example, the engine cylinders are equipped at their individual intake manifolds with fuel injection valves which are controlled in inject the fuel simultaneously for all the cylinders.

The aforementioned two-cycle engine may fail to start by chance so that the combustion chambers are filled up with fuel or the ignition plugs are covered by the unburnt fuel. As counter-measures for these failures, there exists a method of exchanging the wet ignition plugs for new plugs, a method of idly cranking with the ignition plugs being removed, or a method of idly cranking with wiring lines of a control unit or the fuel injection valves being removed. However, all these conventional methods are troublesome. Especially in a vehicle such as a snowmobile to be run on the snow, the counter-measures have to be accomplished in the snow so that a great deal of hard work is required.

SUMMARY OF THE INVENTION

In view of the aforementioned problems in the prior art, the present invention has an object providing an engine start control system which can easily scavenge the combustion chambers thereby to facilitate restarting of the engine by stopping the fuel supply upon the failure of the engine to start again.

Another object of the present invention is to provide an engine start control system which can easily scavenge the combustion chambers based on a control switch to stop fuel supply which is provided in addition to an engine key switch when the engine fails to start.

A further object of the present invention is to provide an engine start control system which can easily scavenge the combustion chambers based on opening of a throttle valve in an intake manifold of an engine when the engine fails to start. The opening of the throttle valve may be a signal that a driver of the engine wants to start the engine.

According to the present invention, therefore, there is provided an engine start control system with an electronic fuel injection valve which comprises, as shown in FIG. 1A, a control switch to be turned on or off which is provided in addition to an engine key switch, means for deciding whether or not an output signal from the control switch is a signal to scavenge a combustion chamber of the engine, means for detecting engine speed, means for deciding whether or not the engine is revolving basing on an output signal of the engine speed detecting means, and means for controlling the injection valve to stop the fuel supply for the injection valve in response to signals outputted from the two deciding means when engine revolutions are almost absent and the control switch is turned on.

Consequently, the conventional counter-measures for failures in engine starting such as the method of idly cranking with the ignition plugs being removed and the method of idly cranking with wiring lines of the control unit of the fuel injection valves being removed may not be necessary.

According to the structure shown in FIG. 1A, engine cranking can be easily performed by turning on the control switch when the engine fails to start so that the engine stops its revolutions despite an engine key being turned on to the position of engine start. Therefore the combustion chambers can be scavenged and the fuel injected into the combustion chambers discharged from the chambers. Since these operations are performed only when the engine stops, there arises no problem. Engine cranking never occurs even if the control switch is turned on during operation of the engine or when the engine is successful in starting.

According to the present invention, there is also provided an engine start control system which comprises, as shown in FIG. 1B, means for detecting an opening-degree of the throttle valve in an intake passage of the engine and means for deciding whether or not the opening degree of the throttle valve is equal to or more than a predetermined value. The throttle valve opening degree detecting means is substituted for the control switch shown in FIG. 1A. The throttle valve opening degree deciding means is also substituted for the control switch Output Signal Deciding means shown in FIG. 1A. The throttle valve opening degree detecting means may be recognized as one of means, which are the same as the control switch in FIG. 1A, for detecting the intention of a driver, who wishes to scavenge the combustion chambers of the engine when the engine fails to start and to open the throttle valve to an opening degree equal to or more than a predetermined value.

According to the structure shown in FIG. 1B, the combustion chambers can be scavenged by cranking the engine (while the engine is revolving at a number of revolutions equal to or less than a predetermined value) with the opening of the throttle valve being equal to or more than a predetermined value.

Thus, restarting of the engine can be accomplished without failure by simple operations to take effective counter-measures for the failure of the engine to start.

The present invention will be described as follows in connection with the embodiments thereof with reference to the accompanying drawings.

DESCRIPTION OF THE PREFERRED EMBODIMENTS

Figure 2:
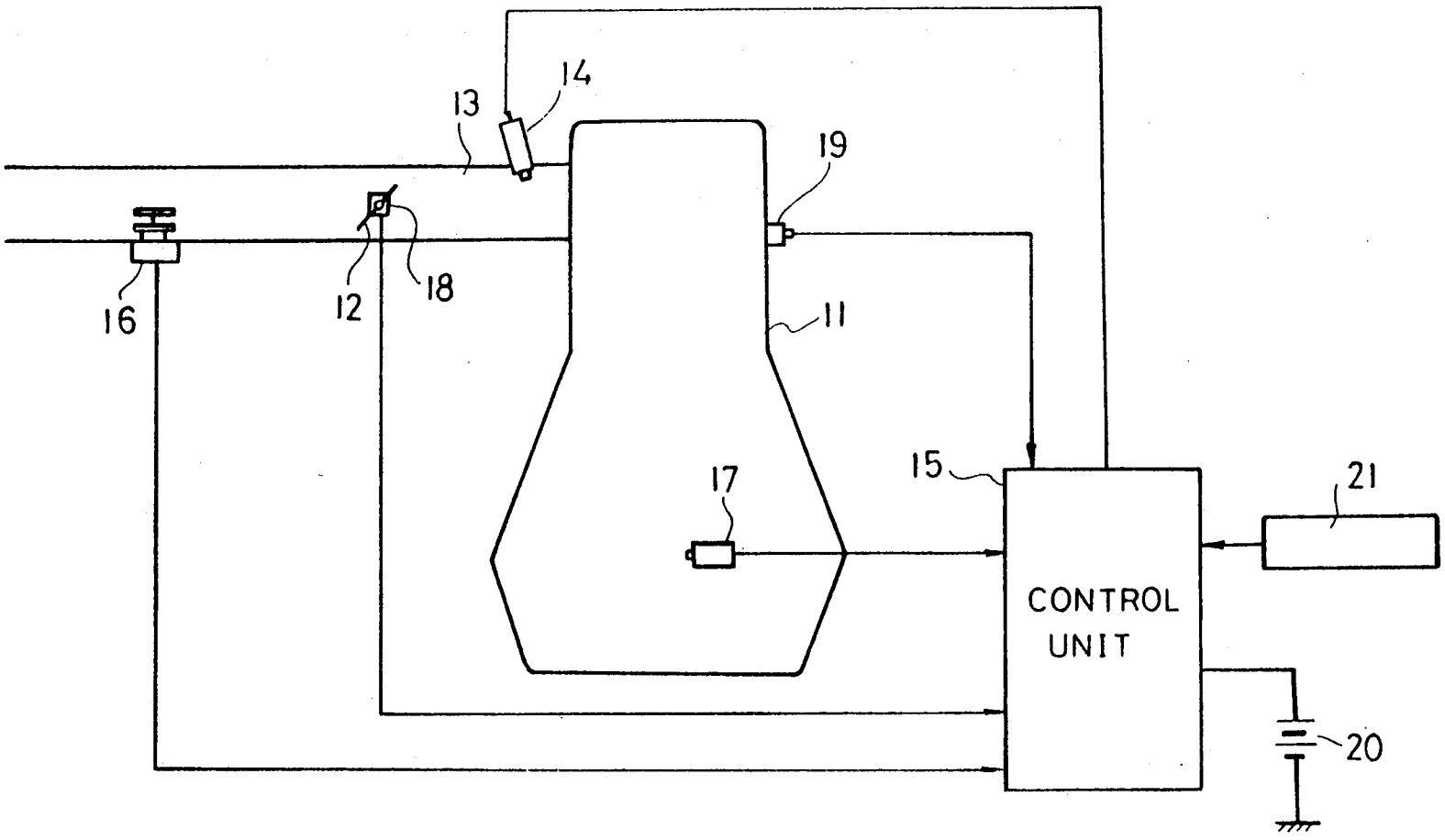
FIG. 2 is a system diagram showing one embodiment of the present invention.

FIG. 2 is a diagram showing the control system of a two-cycle engine according to the present invention. An engine body 11 intakes air from a air cleaner (not shown) through a throttle valve 12 associated with an accelerator and through an intake manifold 13.

The intake manifold 13 has its branches equipped with fuel injection valves 14, respectively, for the engine cylinders. Each fuel injection valve 14 is an electromagnetic type, opened and closed when its solenoid is energized and deenergized. In response to a drive pulse signal coming from a control unit 15, the fuel injection valve 14 is opened, with its solenoid energized, to inject the fuel, which is pumped by a fuel pump (not shown) and has its pressure regulated to a predetermined level by a pressure regulator, into the engine body 11.

The control unit 15 processes the output signals, which are fed from a variety of sensors, by its built-in microcomputer to determined a fuel injection rate (or injection time) Ti and an injection timing (or injection type) and accordingly outputs a drive pulse signal to the fuel injection valve 14.

The aforementioned various sensors are exemplified by an air flow meter 16 which is disposed in the intake manifold 13 upstream of the throttle valve 12 to output a signal according to an intake air flow rate Q. Another sensor is a crank angle sensor 17 acting as an engine speed sensor which is built in a distributor (not shown) to output a reference signal at every crank angle of 120 degrees. Here engine speed can be detected as the number of revolutions N per minute (R.P.M.) of the engine by measuring the period of the aforementioned reference signal.

Still another sensor is a throttle sensor 18 of the potentiometer type, which is attached to the throttle valve 12, to output a signal according to the opening angle $\alpha$ of the throttle valve 12. A further sensor is a water temperature sensor 19, which is attached to the water jacket of the engine body 11, to output a signal according to cooling water temperature Tw as representative of the engine temperature. In the case of the two-cycle engine, fresh air is supplied to the combustion chamber through a crankcase chamber so that it is influenced directly by the temperature of the crankcase. Therefore, the crankcase temperature may be used as the engine temperature in place of the cooling water temperature. The control unit 15 is supplied with the voltage of a battery 20 as its operating power for a supply voltage VB.

Figure 3:
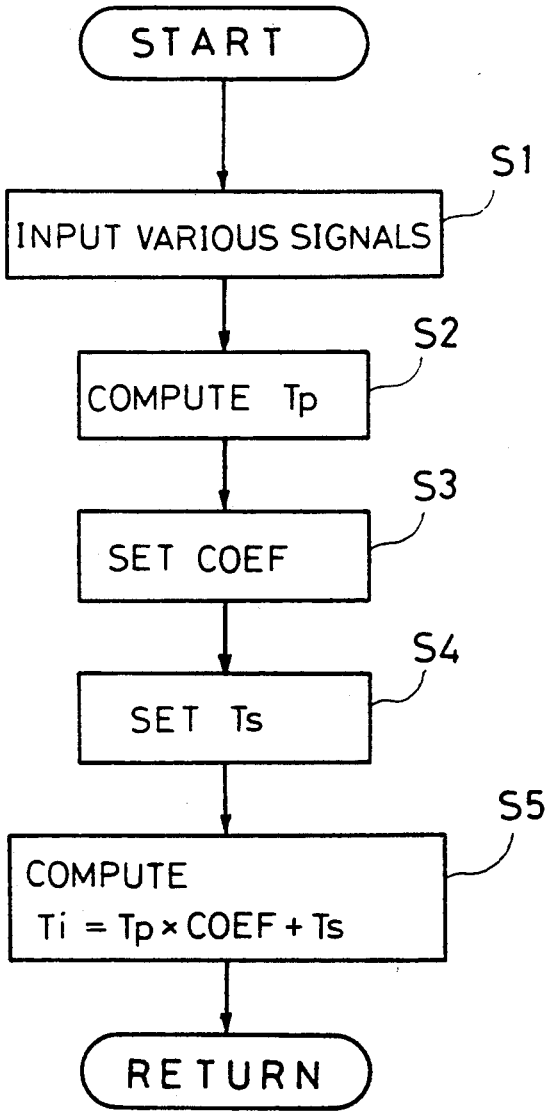
FIG. 3 is a flow chart showing a fuel injection control routine of the present invention.

Next, the fuel injection setting routines by the microcomputer in the control unit 15 will be described with reference to the flow chart of FIG. 3.

At step 1 (as will be abbreviated by "S1" as in the Drawings), the data about the engine running state detected by the individual sensors are inputted.

At step 2, a fundamental fuel injection rate $Tp=K\cdot Q/N$ (K represents a constant) is computed on the basis of the intake air flow rate Q and the engine speed N.

At step 3, a variety of correction coefficients COEF are set basing on the cooling water temperature Tw representing the engine temperature and another data of the engine running state.

At step 4, a voltage correction Ts is set according to the voltage VB of the battery 20. This voltage correction Ts is used to correct the change of the effective open time period of the fuel injection valve 14 due to the change of the battery voltage VB.

At step 6, the actual fuel injection rate is computed from the values Tp, COEF and Ts by the following Equation.

$$Ti=Tp\times COEF+Ts.$$

In the control unit 15, several electronical functions or means are provided which comprise; means for deciding whether or not the output signal from the control switch 21 is a signal turned on to scavenge a combustion chamber of the engine, means for deciding whether or not the engine is revolving in response to the output signal of the crank angle sensor 17 and means for controlling the fuel injection quantity so as to stop the fuel supply from the injection valve 14 according to signals outputted from the two deciding means when engine revolutions are absent and the control switch is turned on.

The operations of the aforementioned individual means will be described with reference to the flow charts of FIGS. 4 and 5.

Figure 4:
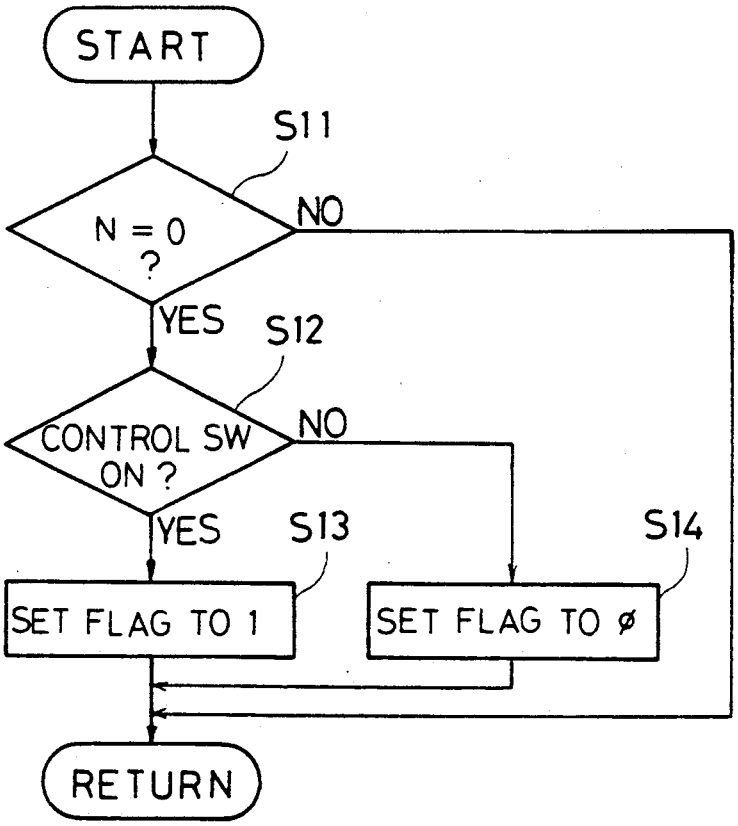
FIGS. 4 and 5 are flow charts showing the control routines of the individual embodiments of the present invention shown in FIG. 1A.

FIG. 4 shows a decision routine for the conditions for stopping the fuel supply at the cranking time after the failure of an engine start. At step 11, it is decided whether or not the engine speed is 0. If YES, the routine advances to step 12. Otherwise, the routine goes to RETURN.

At step 12, it is decided whether or not the aforementioned control switch 21 is turned on. If YES, the driver's intention to scavenge the combustion chamber in the engine is assumed and the routine advances to step 13, at which the flag is set to 1, and then to RETURN.

If NO, the routine advances to step 14, at which the flag is set to 0, and then to RETURN.

Figure 5:
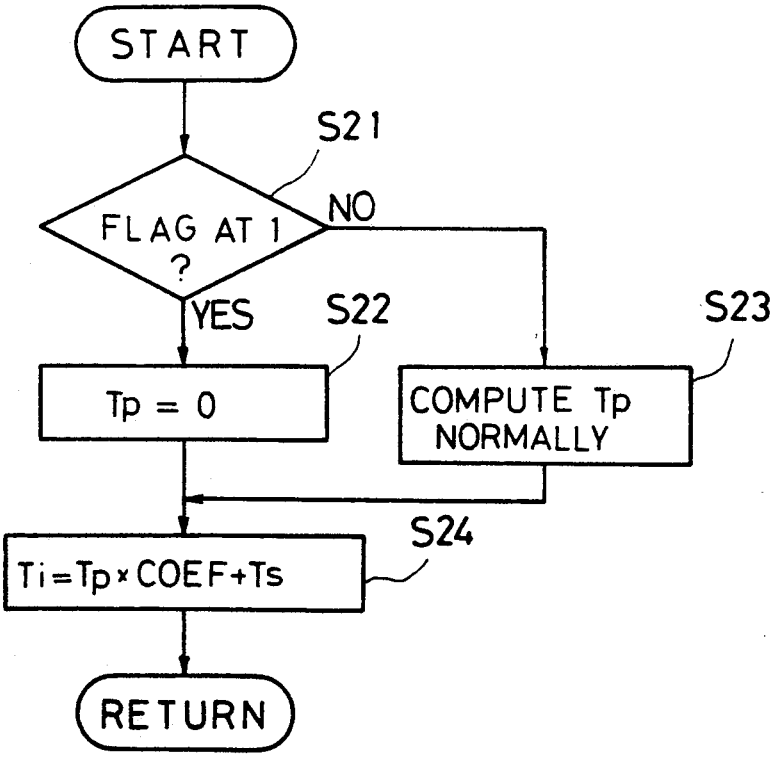

FIG. 5 shows a control routine for stopping the fuel supply. At step 21, it is decided whether or not the flag of the routine of FIG. 4 was set to 1. If YES, the routine advances to step 22, at which the fuel injection is stopped (i.e., Tp =0). If NO, the routine advances to step 23, at which the normal fuel injection is accomplished. In other words, the value Tp is computed from the foregoing equation.

Here, in the case of the so called $\alpha-N$ system, in which the fundamental fuel injection rate Tp is to be determined from the opening degree $\alpha$ of the throttle valve 12 and the engine speed N, the fundamental fuel injection rate Tp corresponding to the actual opening degree $\alpha$ of the throttle valve 12 and the actual engine speed N is retrieved and read in with reference to the map from a ROM, which has been experimentally determined and stored in advance from the injection quantity or the injection rate Tp corresponding to the opening degree $\alpha$ and the engine speed N.

At step 24, the actual fuel injection rate is computed from the foregoing equation $Ti=Tp\times COEF+Ts$.

Here, step 11 corresponds to the means of the present invention for deciding whether or not the engine is revolving, and step 22 corresponds to the means for controlling the fuel injection rate so as to stop the fuel supply.

Figure 6:
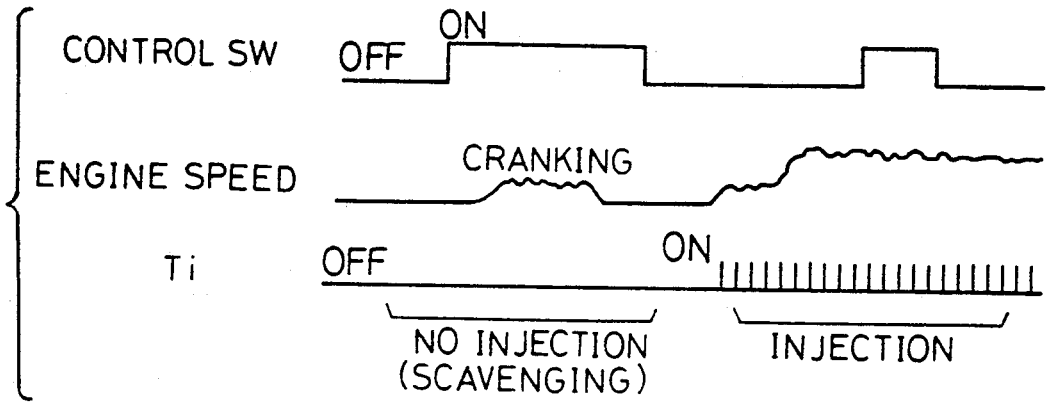
FIG. 6 is a time chart showing controls of the same embodiments.

Incidentally, FIG. 6 shows the time chart for the control operations thus far described.

According to this structure, the combustion chambers are scavenged upon the failure of engine start by cranking the engine with the control switch 21 being on. Since this operation is accomplished only when the engine stops, there arises no problem even if the control switch 21 is erroneously turned on while the engine is revolving.

Thus, the counter-measures for the failure of the engine to start will require none of the prior troublesome work such as the method of changing the ignition plugs, the method of idly cranking with the ignition plugs being removed, or the method of idling cranking with the wiring lines of the control unit or the fuel injection valves being removed. As a result, the engine can be restarted without any difficulty. These counter-measures require none of the troublesome labors especially in a vehicle such as a snowmobile to be driven on the snow and are extremely useful.

Figure 1A:
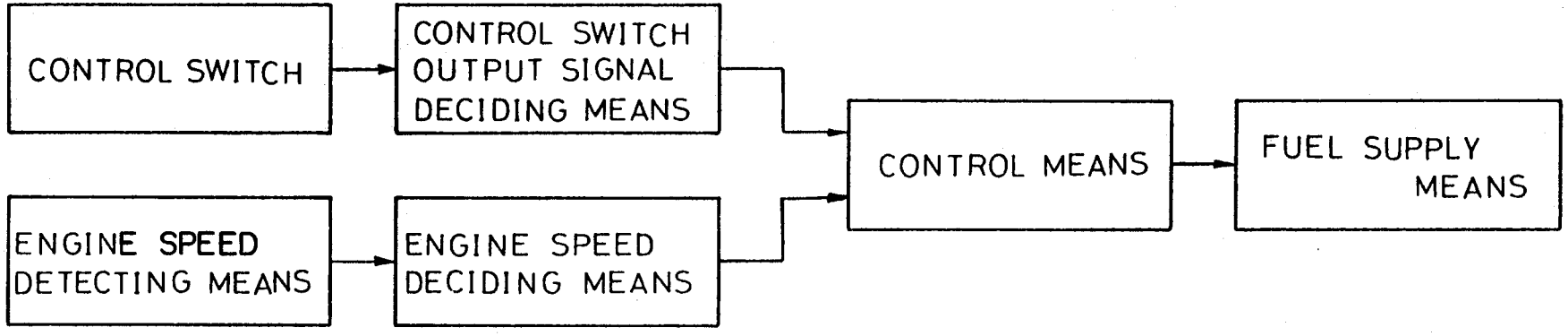
FIGS. 1A and 1B are block diagrams respectively showing concepts of the present invention.
Figure 1B:
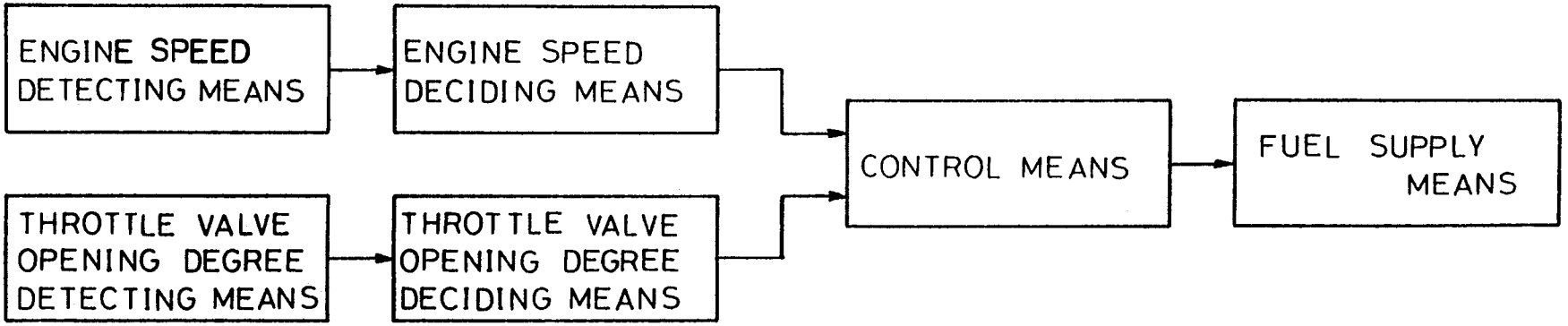

A second embodiment of the present invention may comprise inclusion in the control unit 15 of means for deciding whether or not the opening degree of the throttle valve 12 is equal to or more than a predetermined value as shown in FIG. 1B which substitutes for the means for deciding the control switch output signal as shown in FIG. 1A. Both means provide the same means for detecting the intention of a driver who wants to scavenge the combustion chamber of the engine. The opening degree of the throttle valve 12 is detected by the throttle sensor 18. The means for controlling the fuel injection quantity stops the fuel supply from the injection valve 14 when the signal outputted from the throttle valve opening-degree deciding means shows an opening degree equal to or more than a predetermined value $\alpha$ as well as when the engine speed is judged by the engine speed deciding means to be equal to or less than a predetermined value.

The operations of the second embodiment of the present invention recited above will be described in the following with reference to the flow charts of FIGS. 7 and 8.

Figure 7:
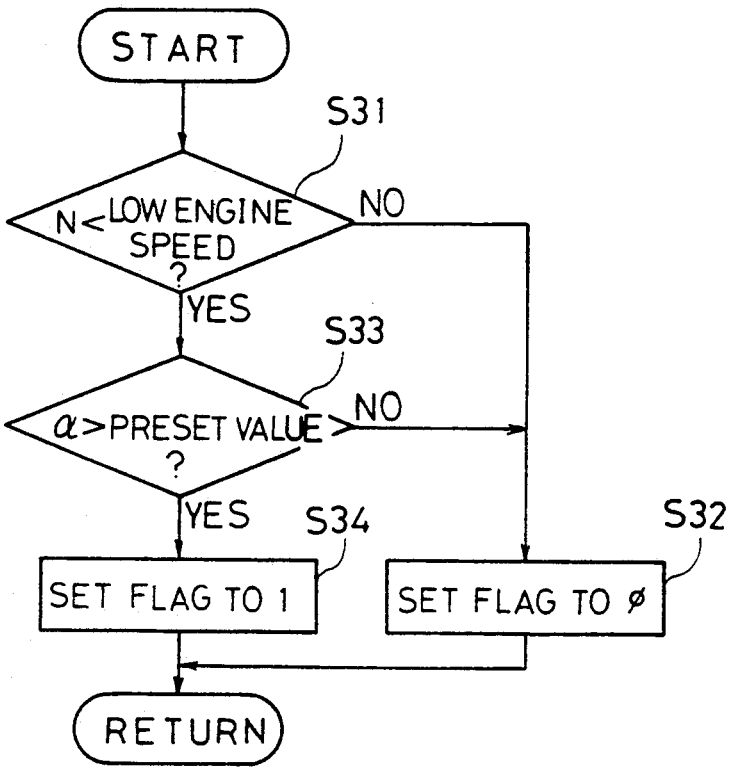
FIGS. 7 and 8 are flow charts showing the control routines of the individual embodiments of the present invention shown in FIG. 1B.

FIG. 7 shows a routine for deciding the conditions for stopping the fuel supply at the cranking time after the failure of an engine start. At step 31, it is decided whether or not the engine speed N is equal to or lower than a predetermined low value. If NO, the routine advances to step 32, at which the flag is set to 0. If YES, the failure to the engine is assumed and the routine advances to step 33, at which it is decided whether or not the throttle valve opening angle $\alpha$ is equal to or higher than a predetermined large value. If NO, the routine advances to step 32, at which the flag is set to 0. If YES, the intention of driver to scavenge the combustion chamber of the engine is assumed because of failure of the engine to start and the routine advances to step 34, at which the flag is set to 1.

Incidentally, a hysteresis may be added to the decided engine speed N. If, in this case, the hysteresis added is extreme, the decided speed N can be dropped to 0 once it is exceeded.

Figure 8:
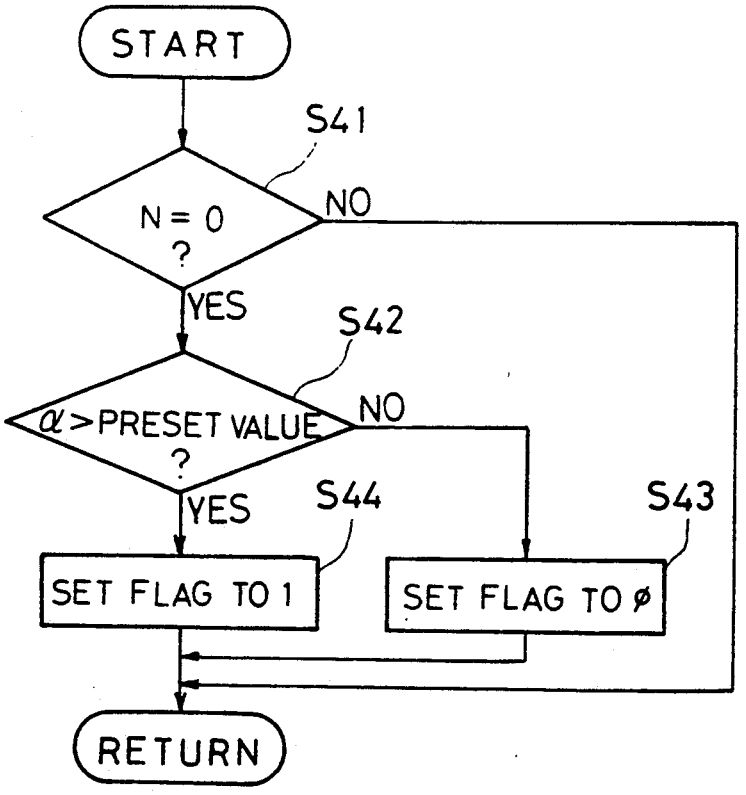

The routine for deciding the conditions for stopping the fuel supply in the case of the decided engine speed N of 0 is shown in FIG. 8.

At step 41, it is decided whether or not the engine speed is 0 or less than the predetermined level. If NO, the routine advances to RETURN. If YES, the routine advances to step 42, at which it is decided whether or not the throttle valve opening angle $\alpha$ is equal to or larger than a predetermined large value. If NO, the routine advances to step 43, at which the flag is set to 0. If YES, the routine advances to step 44, at which the flag is set to 1.

In this second embodiment, too, the controls for stopping the fuel injection are executed in accordance with the control routine for stopping the fuel supply of FIG. 5.

Figure 9:
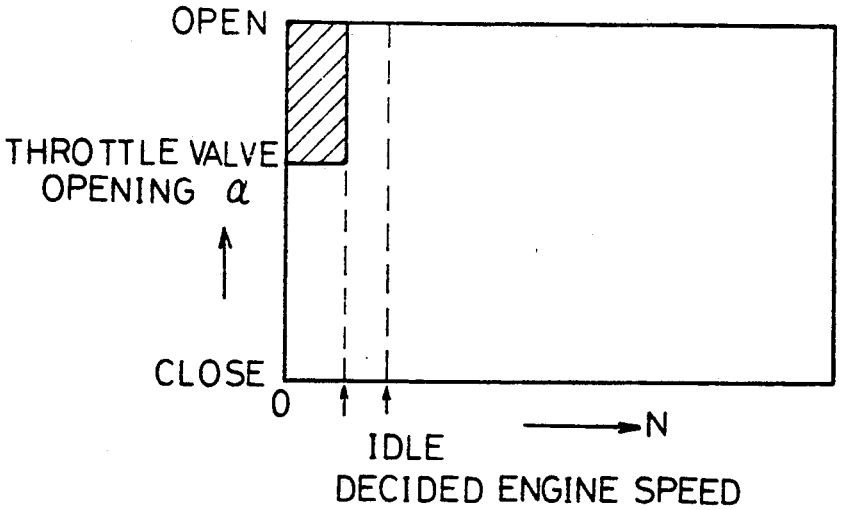
FIG. 9 is a diagram showing control of the same embodiment shown in FIGS. 7 and 8.

Incidentally, the hatched zone of FIG. 9 indicates the aforementioned fuel injection stopping zone.

According to this structure, the combustion chambers can be scavenged upon the failure of an engine to start by cranking the engine with a throttle valve opening equal to or more than a predetermined value. At the same time, the engine restart can be accomplished without failure by simple operations to provide effective counter-measures for the failure of the engine start.

According to the engine start control system of the present invention, as has been described hereinbefore, the combustion chambers are scavenged upon the failure of engine to start by cranking the engine with the control switch being on. Since, moreover, this operation is accomplished only when the engine stops or almost stops, there arises no problem even if the control switch 21 is erroneously turned on while the engine is revolving.

On the other hand, the combustion chambers can be scavenged upon the failure of an engine to start by cranking the engine with a throttle valve opening equal to or more than a predetermined value.

As a result, the engine restart can be accomplished without failure by simple operations to provide effective counter-measures for the failure of the engine start.

Especially for a vehicle such as the snowmobile driven on the snow, the present invention provides remarkably effective and useful counter-measures for the failure of the engine to start.

What is claimed is:

1. An engine start control system with an electronically controlled fuel injection valve which comprises; a control switch which is provided in addition to an engine key switch and can be turned on or off when scavenging of a combustion chamber of said engine is requested, means for deciding whether or not an output signal form said control switch is a signal to scavenge said combustion chamber, means for detecting engine speed, means for deciding whether or not said engine is revolving based on an output signal of said engine speed detecting means, and means for controlling a fuel injection rate to stop fuel supply to said injection valve in response to signals outputted from said two deciding means when said engine speed is almost absent and said control switch is turned on.

2. An engine start control system as set forth in claim 1, wherein said engine is a two cycle engine with an electronically controlled fuel injection system.

3. An engine start control system as set forth in claim 2, wherein said engine is utilized for a snow mobile.

4. An engine start control system with an electronically controlled fuel injection valve which comprises; means for detecting an opening degree of a throttle valve in an intake passage of said engine, means for deciding whether or not said detected opening degree of said throttle valve is equal to or larger than a predetermined level, means for detecting engine speed, means for deciding whether or not said engine speed is equal to or less than a predetermined value which corresponds to almost zero, means for controlling a fuel injection rate to stop fuel supply to said injection valve in response to signals outputted form said two deciding means when said engine speed is almost absent and said opening degree of said throttle valve is equal to or larger than said predetermined level.

5. An engine start control system as set forth in claim 4, wherein said engine is a two cycle engine with an electronically controlled fuel injection system.

6. An engine start control system as set forth in claim 5, wherein said engine is utilized for a snow mobile.

* * * * *